US012185822B2

(12) United States Patent
Lin

(10) Patent No.: US 12,185,822 B2
(45) Date of Patent: Jan. 7, 2025

(54) DETACHABLE BACKPACK

(71) Applicant: Shenzhen Youmai Network Technology Co., Ltd., Shenzhen (CN)

(72) Inventor: Jiaxuan Lin, Shenzhen (CN)

(73) Assignee: Shenzhen Youmai Network Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/764,580

(22) Filed: Jul. 5, 2024

(65) Prior Publication Data

US 2024/0358142 A1 Oct. 31, 2024

(30) Foreign Application Priority Data

Jun. 26, 2024 (CN) ..... 202421492271.9

(51) Int. Cl.

| | |
|---|---|
| ***A45F 3/04*** | (2006.01) |
| ***A45C 7/00*** | (2006.01) |
| ***A45C 13/00*** | (2006.01) |
| ***A45C 13/18*** | (2006.01) |
| ***A45C 13/30*** | (2006.01) |
| *A45C 13/10* | (2006.01) |

(52) U.S. Cl.

CPC ..... *A45F 3/047* (2013.01); *A45C 7/0086* (2013.01); *A45C 13/002* (2013.01); *A45C 13/18* (2013.01); *A45C 13/30* (2013.01); *A45C 13/10* (2013.01); *A45C 2013/306* (2013.01)

(58) Field of Classification Search

CPC ..... A45F 3/04

USPC ..... 224/583; 190/108

See application file for complete search history.

(56) References Cited

U.S. PATENT DOCUMENTS

| | | | | |
|---|---|---|---|---|
| 5,743,447 | A * | 4/1998 | McDermott | A45C 7/0086 224/583 |
| 5,873,504 | A * | 2/1999 | Farmer | A45C 7/0086 190/110 |
| 6,659,320 | B1 * | 12/2003 | Alves | A45F 3/04 224/652 |
| D500,590 | S * | 1/2005 | Sachen | D3/216 |
| 6,932,256 | B2 * | 8/2005 | Hale | A45F 3/042 224/648 |
| 7,152,772 | B2 * | 12/2006 | Ukitsu | A45F 3/04 224/660 |

(Continued)

*Primary Examiner* — Justin M Larson

(74) *Attorney, Agent, or Firm* — Westbridge IP LLC

(57) ABSTRACT

A detachable backpack includes a primary pack, a secondary pack and a quick-release structure. The primary pack and the secondary pack are detachably connected via the quick-release structure, the primary pack is provided with a first hidden surface, the secondary pack is provided with a second hidden surface, the first hidden surface is configured for fitting with the second hidden surface, the first hidden surface and/or the second hidden surface is provided with an accommodation opening communicating with an inner accommodation space, and opening and closing of the accommodation opening are realized via a closure; when the primary pack and the secondary pack are connected, the closure is located between the first hidden surface and the second hidden surface. By providing the quick-release structure, the primary pack and the secondary pack can be quickly detached and connected, which improves flexibility and convenience of using the backpack.

9 Claims, 7 Drawing Sheets

(56) References Cited

U.S. PATENT DOCUMENTS

| | | | | |
|---|---|---|---|---|
| 7,416,066 | B2 * | 8/2008 | Chernoff | A45C 7/0045 190/115 |
| 7,942,296 | B1 * | 5/2011 | Johnson | A45C 7/0086 224/652 |
| D702,434 | S * | 4/2014 | Chalk | A45F 3/04 D3/217 |
| 8,919,396 | B2 * | 12/2014 | Nieves | A45C 3/06 224/582 |
| D731,788 | S * | 6/2015 | Joo | D3/233 |
| 9,901,161 | B2 * | 2/2018 | Blanton | A42B 1/041 |
| D991,673 | S * | 7/2023 | Li | D3/217 |
| 2007/0017942 | A1 * | 1/2007 | Hubbell | A45F 3/00 224/652 |
| 2007/0045370 | A1 * | 3/2007 | Hsieh | A45F 3/04 190/110 |
| 2007/0051765 | A1 * | 3/2007 | Hsieh | A45C 5/14 190/110 |
| 2007/0125815 | A1 * | 6/2007 | Tong | A45F 4/02 224/583 |
| 2007/0175941 | A1 * | 8/2007 | Berry | A45C 13/02 224/583 |
| 2010/0059322 | A1 * | 3/2010 | Reali | A45C 7/0045 190/108 |
| 2013/0292220 | A1 * | 11/2013 | Kerley | A45C 13/02 190/108 |
| 2024/0260729 | A1 * | 8/2024 | Kim | A45F 3/04 |

* cited by examiner

DETACHABLE BACKPACK

CROSS-REFERENCE TO RELATED APPLICATIONS

This application claims priority to Chinese Patent Application No. 202421492271.9, filed on Jun. 26, 2024, the content of which is incorporated herein by reference in its entirety.

TECHNICAL FIELD

The present disclosure relates to the technical field of backpacks, and more particularly to a detachable backpack.

BACKGROUND

With the rapid pace of modem life, people's demand for backpacks is growing, which not only requires basic loading functions, but also expects that their design can meet multiple requirements with flexibility and security. However, existing backpack designs have some limitations:

Limit of single structure: most backpacks adopt a fixed structure, and the primary pack and secondary pack are not separable, which limits the user's flexibility to use the backpack on different occasions and needs.

Defect of seal design: the closures (zippers, snaps, drawstrings, etc.) of existing backpacks are often exposed to the outside, not only affecting the aesthetics of the backpack but also being susceptible to thefts. In public places, such as crowded public traffic or busy streets, exposed closures increase the risk of thefts to the items.

SUMMARY

The technical problem to be solved by the present disclosure is to provide a detachable backpack with good flexibility and high security.

In order to solve the above-mentioned technical problem, the technical solution adopted by the present disclosure is a detachable backpack, including a primary pack, a secondary pack and a quick-release structure, the primary pack and the secondary pack being detachably connected via the quick-release structure, the primary pack and the secondary pack both having an inner accommodation space, the primary pack being provided with a first hidden surface, the secondary pack being provided with a second hidden surface, the first hidden surface being configured for fitting with the second hidden surface, the first hidden surface and/or the second hidden surface being provided with an accommodation opening communicating with the inner accommodation space, a closure being provided at the accommodation opening, and opening and closing of the accommodation opening being realized via the closure, the closure being positioned between the first hidden surface and the second hidden surface when the primary pack and the secondary pack are connected.

Further, the quick-release structure includes a first connector and a second connector detachably connected to the first connector, the first connector being provided on the primary pack and the second connector being provided on the secondary pack.

Further, the first connector is provided on the first hidden surface and the second connector is provided on the second hidden surface.

Further, a first flexible shield is provided within the inner accommodation space of the primary pack, the accommodation opening is provided on the first hidden surface, and the first flexible shield is configured to shield the first connector.

Further, the first flexible shield is provided with the second connector.

Further, a second flexible shield is provided within the inner accommodation space of the secondary pack, the accommodation opening is provided on the second hidden surface, and the second flexible shield is configured to shield the second connector.

Further, the second flexible shield is provided with the first connector.

Further, the quick-release structure is a flexible binding piece.

Further, the flexible binding piece is provided on the primary pack, and the flexible binding piece abuts against a side, facing away from the secondary pack, of the secondary pack.

Further, the flexible binding piece is provided on the secondary pack, and the flexible binding piece abuts against a side, facing away from the primary pack, of the primary pack.

The present disclosure has the advantageous effect that the detachable backpack provided by the present disclosure has the features of good flexibility and high safety. By providing the quick-release structure, the primary pack and the secondary pack of the backpack can be quickly detached and connected, and the flexibility and convenience of using the backpack are improved.

At the same time, the fitting design of the hidden surfaces allows the closure to be hidden in a connected state, increasing aesthetics and safety of the backpack.

DETAILED DESCRIPTION OF THE EMBODIMENTS

Figure 1:
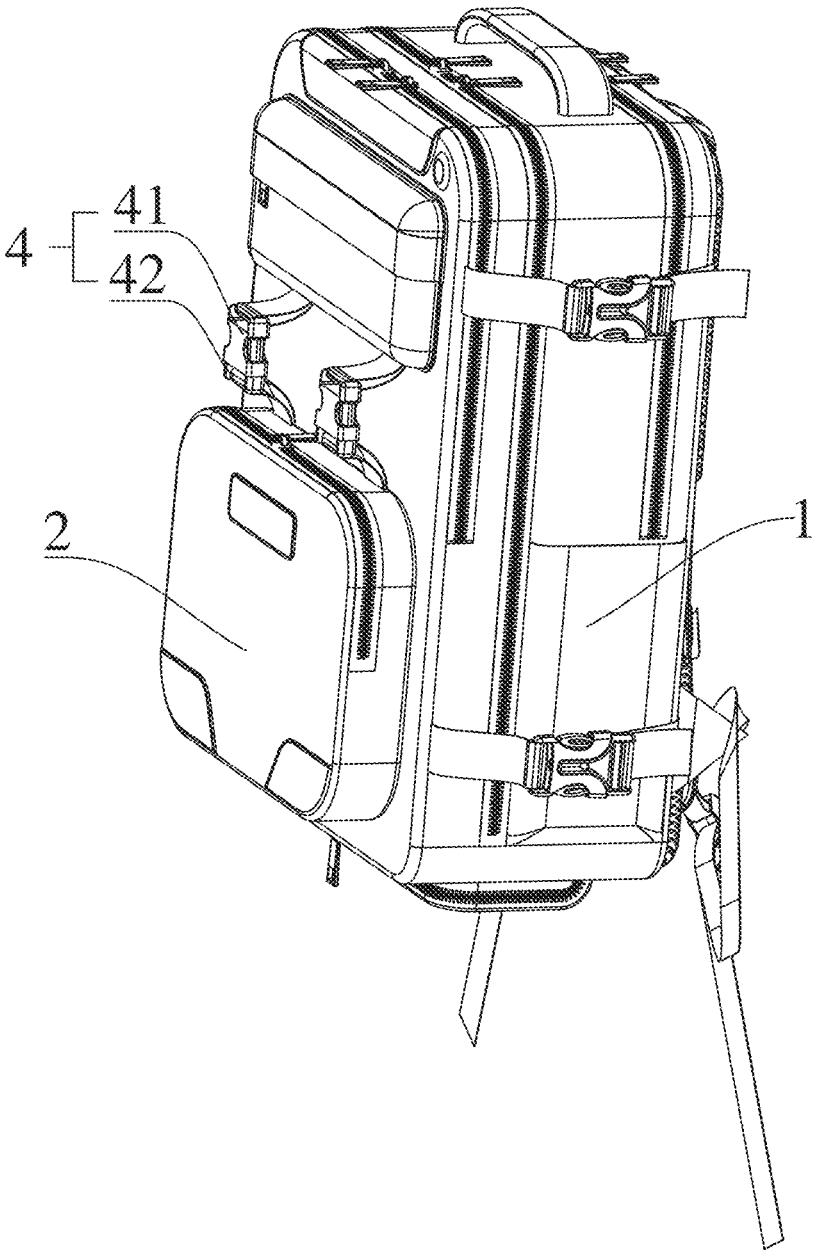
FIG. 1 is a schematic structural diagram of a detachable backpack (in an assembled state) according to one or more embodiments.

In order to explain the technical contents, the achieved objects and the effects of the present disclosure in detail, the following description is made in conjunction with the implementations and the accompanying drawings.

With reference to FIGS. 1 to 7, there is provided a detachable backpack, including a primary pack 1, a secondary pack 2 and a quick-release structure 4, the primary pack 1 and the secondary pack 2 being detachably connected via the quick-release structure 4, the primary pack 1 and the secondary pack 2 both having an inner accommodation space, the primary pack 1 being provided with a first hidden surface 11, the secondary pack 2 being provided with a second hidden surface 21, the first hidden surface 11 being configured for fitting with the second hidden surface 21, the first hidden surface 11 and/or the second hidden surface 21 being provided with an accommodation opening 31 communicating with the inner accommodation space, a closure 3 being provided at the accommodation opening 31, and opening and closing of the accommodation opening 31 being realized via the closure 3, the closure 3 being positioned between the first hidden surface 11 and the second hidden surface 21 when the primary pack 1 and the secondary pack 2 are connected.

As apparent from the above-mentioned description, the present disclosure has an advantageous effect in that the primary pack 1 and the secondary pack 2 of the backpack both have independent inner accommodation spaces, so that a user can choose to use them alone or in combination according to different loading requirements and use scenarios, increasing the practicability and flexibility of the backpack; the design of the quick-release structure 4 allows the user to quickly and conveniently connect or separate the primary pack 1 and the secondary pack 2 without complicated operations or tools, greatly improving the use efficiency and satisfying the pursuit of efficiency in the fast-paced life; the fitting design of the first hidden surface 11 and the second hidden surface 21 not only makes the appearance of the backpack neat and uniform in a connected state, but also enhances the aesthetics and the overall feeling of the backpack by hiding the closure 3, so as to avoid the visual disorder which may be caused by the exposure of the closure 3 like traditional backpacks; the concealed arrangement of the closure 3, in addition to improving aesthetics, also has practical functionality. The hidden closure 3 is not easily detected by others, thereby reducing the risk of articles being stolen in public use and improving the security of the backpack; the provision of the accommodation opening 31 allows the user to conveniently access the accommodation space inside the backpack, and the opening and closing mechanism of the closure 3 ensures the safety and stability of the loaded articles, preventing the articles from being accidentally dropped during movement; the design of the inner accommodation spaces of the primary pack 1 and the secondary pack 2 can be adjusted and optimized according to the specific requirements of the user. For example, different partitions, pockets or fixing straps can be designed to accommodate different types of articles at storage; the detachable design of the backpack also allows the user to choose to carry the primary pack 1 or the secondary pack 2 or both together according to the length of travel or the requirements of daily use, providing a high degree of personalization and customization options; this design of the backpack is also of environmental interest as it encourages the user to select the pack body portion to be carried according to actual needs, reducing unnecessary resource consumption and environmental burden.

Further, the quick-release structure 4 includes a first connector 41 and a second connector 42 detachably connected to the first connector 41, the first connector 41 being provided on the primary pack 1 and the second connector 42 being provided on the secondary pack 2.

As can be seen from the above-mentioned description, the design of the first connector 41 and the second connector 42 allows the primary pack 1 and the secondary pack 2 to be easily separated when not needed and to be quickly connected when needed, enhancing the versatility of the backpack and the ability to adapt to different use scenarios.

Further, the first connector 41 is provided on the first hidden surface 11 and the second connector 42 is provided on the second hidden surface 21.

As can be seen from the above-mentioned description, the connector is arranged on the hidden surface, and when the primary pack 1 and the secondary pack 2 of the backpack are fitted, the connector is shielded and not exposed, so as to keep the appearance of the backpack clean and uniform.

Further, a first flexible shield 12 is provided within the inner accommodation space of the primary pack 1, the accommodation opening 31 is provided on the first hidden surface 11, and the first flexible shield 12 is configured to shield the first connector 41.

As can be seen from the above-mentioned description, the use of the first flexible shield 12 not only shields the first connector 41, protects the connecting structure from damage, but also provides an additional interior space dividing or organizing function.

Further, the first flexible shield 12 is provided with the second connector 42.

As can be seen from the above-mentioned description, the additional provision of the second connector 42 on the first flexible shield 12 ensures that the first flexible shield 12 can effectively and stably shield the first connector 41 when the primary pack 1 is used alone.

Further, a second flexible shield 32 is provided within the inner accommodation space of the secondary pack 2, the accommodation opening 31 is provided on the second hidden surface 21, and the second flexible shield 32 is configured to shield the second connector 42.

As can be seen from the above-mentioned description, the use of the second flexible shield 32 not only shields the second connector 42, protects the connecting structure from damage, but also provides an additional interior space dividing or organizing function.

Further, the second flexible shield 32 is provided with the first connector 41.

As can be seen from the above-mentioned description, the additional provision of the first connector 41 on the second flexible shield 32 ensures that the second flexible shield 32 can effectively and stably shield the second connector 42 when the secondary pack 2 is used alone.

Further, the quick-release structure 4 is a flexible binding piece.

As can be seen from the above-mentioned description, the use of the flexible binding piece provides a novel quick-release structure 4 that may have greater flexibility and adaptability, allowing the user to adjust the degree of fastening of the backpack as desired.

Further, the flexible binding piece is provided on the primary pack 1, and the flexible binding piece abuts against a side, facing away from the second hidden surface 21, of the secondary pack 2.

As can be seen from the above-mentioned description, the flexible binding piece is provided on the primary pack 1, which interferes with one side of the secondary pack 2, such a design enhancing the structural stability of the backpack as a whole, especially when carrying heavy objects or irregularly shaped objects.

Further, the flexible binding piece is provided on the secondary pack 2, and the flexible binding piece abuts against a side, facing away from the first hidden surface 11, of the primary pack 1.

As can be seen from the above-mentioned description, the flexible binding piece is provided on the secondary pack 2, abutting against one side of the primary pack 1, and this design allows the secondary pack 2 to be more flexibly fixed on the primary pack 1, providing personalized adjustment options and better adaptability.

With reference to FIGS. 1 to 7, an embodiment of the present disclosure is a detachable backpack, including a primary pack 1, a secondary pack 2 and a quick-release structure 4, the primary pack 1 and the secondary pack 2 being detachably connected via the quick-release structure 4, the primary pack 1 and the secondary pack 2 both having an inner accommodation space, the primary pack 1 being provided with a first hidden surface 11, the secondary pack 2 being provided with a second hidden surface 21, the first hidden surface 11 being configured for fitting with the second hidden surface 21, the first hidden surface 11 and/or the second hidden surface 21 being provided with an accommodation opening 31 communicating with the inner accommodation space, and a closure 3 being provided at the accommodation opening 31, opening and closing of the accommodation opening 31 being realized via the closure 3; when the primary pack 1 is connected to the secondary pack 2, the closure 3 is located between the first hidden surface 11 and the second hidden surface 21; the primary pack 1 and the secondary pack 2 of the backpack both have independent inner accommodation spaces, so that a user can choose to use them alone or in combination according to different loading requirements and use scenarios, increasing the practicability and flexibility of the backpack; the design of the quick-release structure 4 allows the user to quickly and conveniently connect or separate the primary pack 1 and the secondary pack 2 without complicated operations or tools, greatly improving the use efficiency and satisfying the pursuit of efficiency in the fast-paced life; the fitting design of the first hidden surface 11 and the second hidden surface 21 not only makes the appearance of the backpack neat and uniform in a connected state, but also enhances the aesthetics and the overall feeling of the backpack by hiding the closure 3, so as to avoid the visual disorder which may be caused by the exposure of the closure 3 like traditional backpacks; the concealed arrangement of the closure 3, in addition to improving aesthetics, also has practical functionality. The hidden closure 3 is not easily detected by others, thereby reducing the risk of articles being stolen in public use and improving the security of the backpack; the provision of the accommodation opening 31 allows the user to conveniently access the accommodation space inside the backpack, and the opening and closing mechanism of the closure 3 ensures the safety and stability of the loaded articles, preventing the articles from being accidentally dropped during movement; the design of the inner accommodation spaces of the primary pack 1 and the secondary pack 2 can be adjusted and optimized according to the specific requirements of the user. For example, different partitions, pockets or fixing straps can be designed to accommodate different types of articles at storage; the detachable design of the backpack also allows the user to choose to carry the primary pack 1 or the secondary pack 2 or both together according to the length of travel or the requirements of daily use, providing a high degree of personalization and customization options; this design of the backpack is also of environmental interest as it encourages the user to select the pack body portion to be carried according to actual needs, reducing unnecessary resource consumption and environmental burden.

Figure 2:
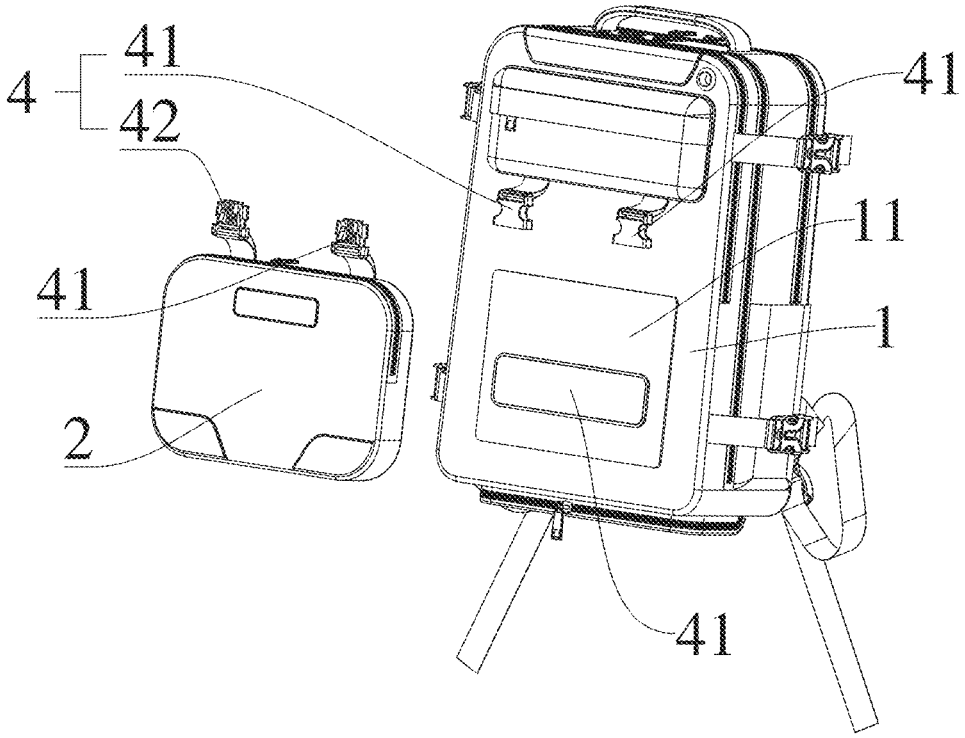
FIG. 2 is a schematic structural diagram of the detachable backpack (in a disassembled state) according to one or more embodiments.
Figure 3:
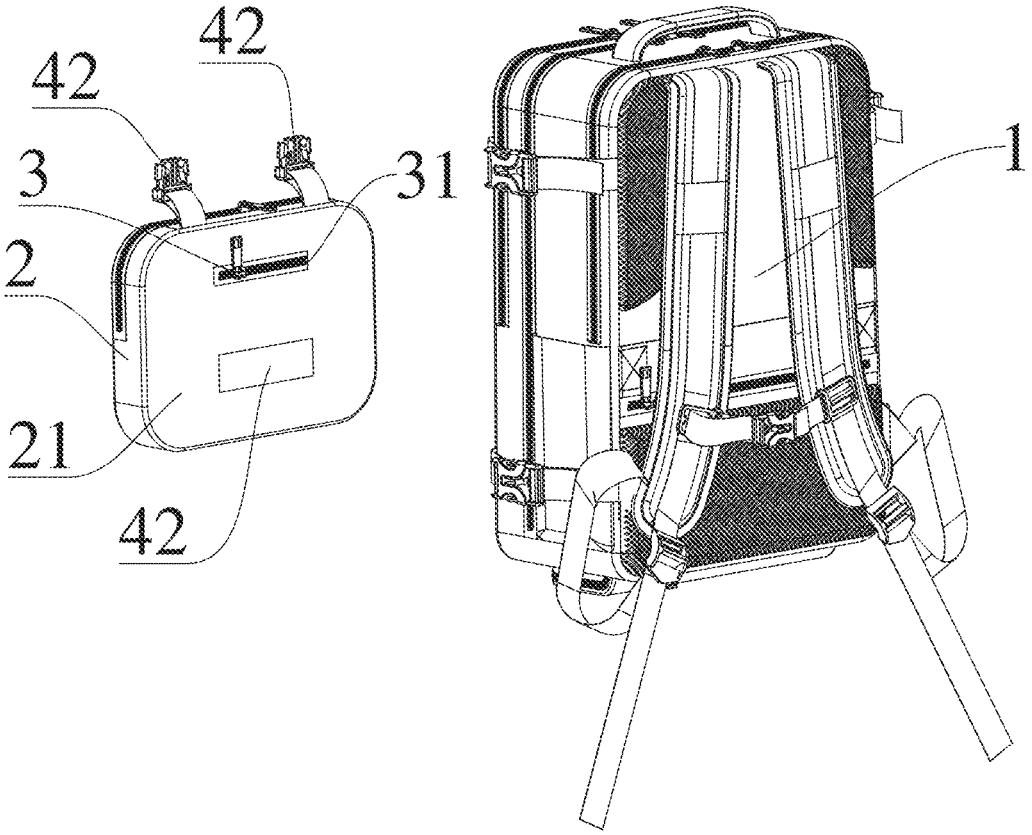
FIG. 3 is a schematic structural diagram of the detachable backpack (in a disassembled state) according to one or more embodiments from another perspective.

With reference to FIGS. 1 to 3, in some embodiments, the quick-release structure 4 includes a first connector 41 and a second connector 42 detachably connected to the first connector 41, wherein the first connector 41 is provided on the primary pack 1, and the second connector 42 is provided on the secondary pack 2; the design of the first connector 41 and the second connector 42 allows the primary pack 1 and the secondary pack 2 to be easily separated when not needed, and to be quickly connected when needed, enhancing the versatility of the backpack and the ability to adapt to different use scenarios; specifically, the first connector 41 is provided on the first hidden surface 11, the second connector 42 is provided on the second hidden surface 21, the connector is provided on the hidden surface, and when the primary pack 1 and the secondary pack 2 of the backpack are fitted, the connector is shielded and not exposed, so as to maintain the appearance of the backpack neat and uniform.

As an option, the number, mounting position and structure type of the quick-release structures 4 can all be set according to actual application requirements, and the quick-release structure 4 includes, but is not limited to, a snap, a magic sticker, a magnet, etc.; the number, mounting position and structure type of the closure 3 can also be set according to actual application requirements, and when the number of closures 3 on the primary pack 1 is multiple, at least one of the closures 3 is located on the first hidden surface 11; accordingly, when the number of closures 3 on the secondary pack 2 is multiple, at least one of the closures 3 is located on the second hidden surface 21; and the closure 3 includes, but is not limited to, a zipper, a snap, a magnet, etc.

With reference to FIGS. 1 to 3, in some embodiments, the number of quick-release structures 4 is three. The two quick-release structures 4 are buckles arranged at a top position of the secondary pack 2, a parent buckle of the buckles is connected to the primary pack 1 as a first connector 41, and a child buckle of the buckles is connected to the secondary pack 2 as a second connector 42; the remaining quick-release structure 4 is a magic sticker, a rough surface of the magic sticker is connected to the primary pack 1 as a first connector 41, and a hook surface of the magic sticker is connected to the secondary pack 2 as a second connector 42; the accommodation opening 31 is provided on the secondary pack 2, a zipper is selected as the closure 3, and the closure 3 is located on the second hidden surface 21.

Figure 4:
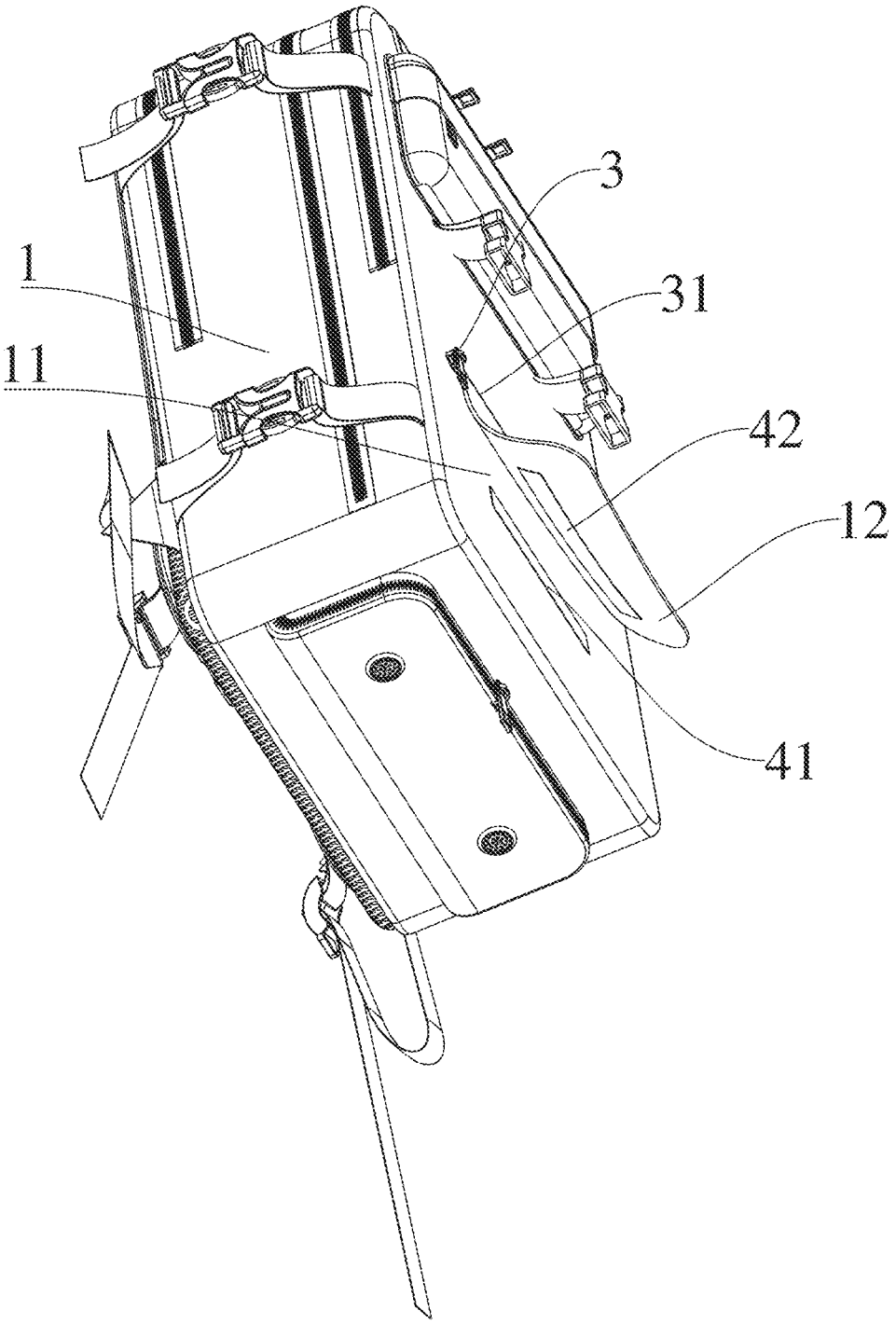
FIG. 4 is a schematic structural diagram of a primary pack (with an opened state of an accommodation opening) according to one or more embodiments.

With reference to FIG. 4, in some embodiments, a first flexible shield 12 is provided in the inner accommodation space of the primary pack 1, the accommodation opening 31 is provided on the first hidden surface 11, the first flexible shield 12 is configured for shielding the first connector 41, and the use of the first flexible shield 12 not only shields the first connector 41, protects the connecting structure from damage, but also can provide an additional inner space division or arrangement function; in particular, the first flexible shield 12 is provided with the second connector 42, and the additional provision of the second connector 42 in the first flexible shield 12 ensures that the first flexible shield 12 effectively and stably shields the first connector 41 when the primary pack 1 is used alone.

Figure 5:
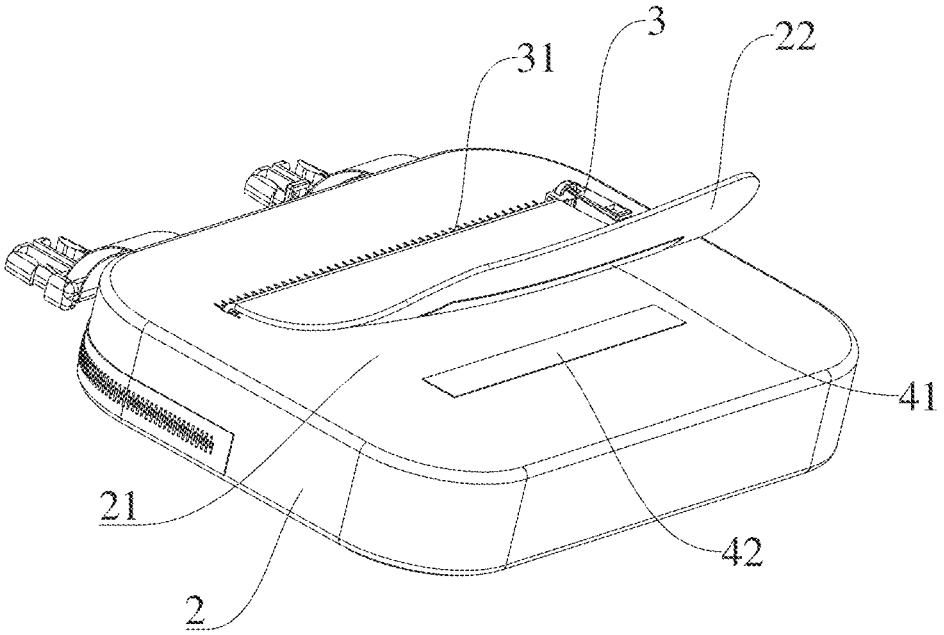
FIG. 5 is a schematic structural diagram of a secondary pack (with an opened state of the accommodation opening) according to one or more embodiments.

With reference to FIG. 5, in some embodiments, a second flexible shield 32 is provided in the inner accommodation space of the secondary pack 2, the accommodation opening 31 is provided on the second hidden surface 21, the second flexible shield 32 is configured for shielding the second connector 42, and the use of the second flexible shield 32 not only shields the second connector 42, protects the connecting structure from damage, but also can provide an additional inner space division or arrangement function; in particular, the second flexible shield 32 is provided with the first connector 41, and the additional provision of the first connector 41 in the second flexible shield 32 ensures that the second flexible shield 32 effectively and stably shields the second connector 42 when the secondary pack 2 is used alone.

Figure 6:
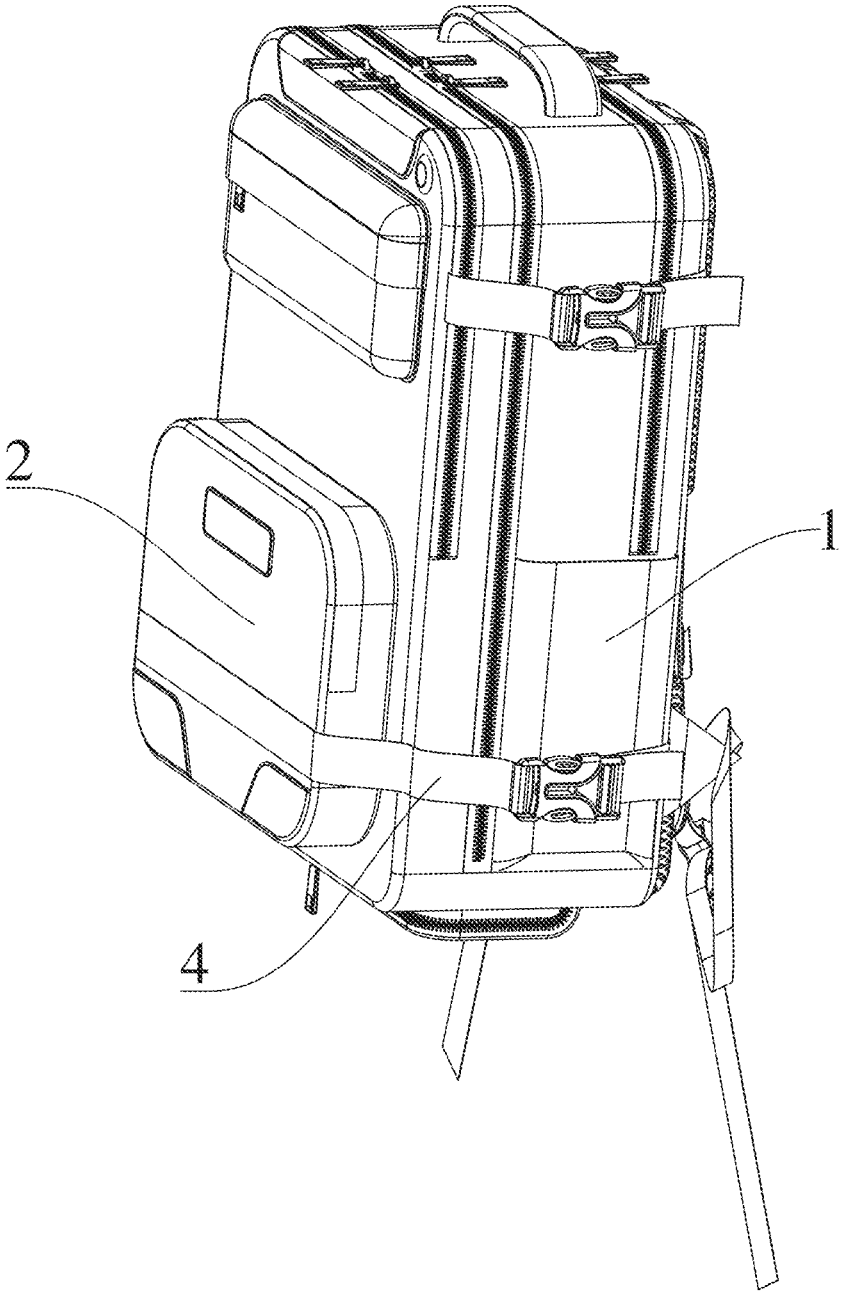
FIG. 6 is a schematic structural diagram of a detachable backpack (in an assembled state) according to one or more embodiments.
Figure 7:
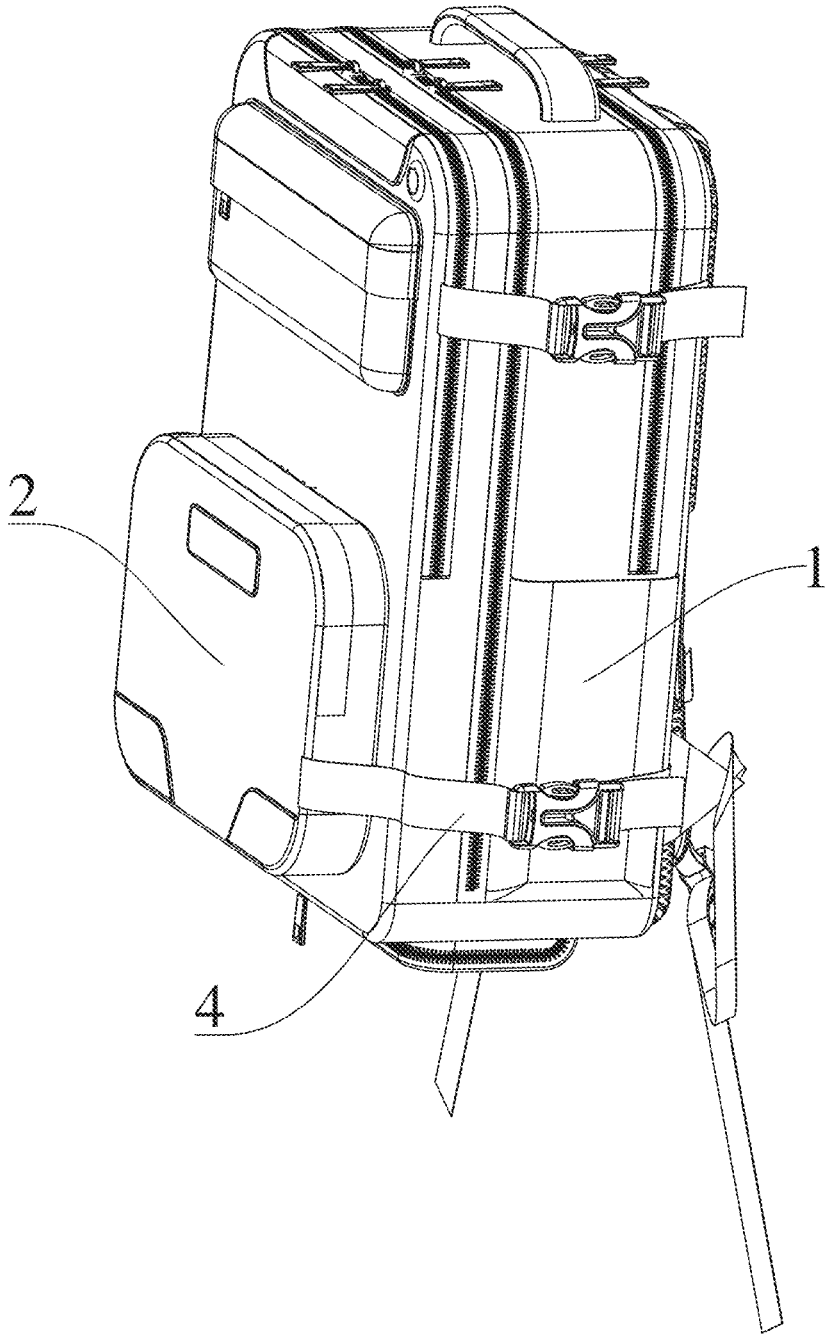
FIG. 7 is a schematic structural diagram of a detachable backpack (in an assembled state) according to one or more embodiments.

In addition, in some other embodiments, the quick-release structure 4 may also be a flexible binding piece, wherein the flexible binding piece includes, but is not limited to, a binding strap, a bunch cord, an elastic cord, a net bag, etc. and the flexible binding piece is provided to fix the primary pack 1 and the secondary pack 2, and has better adaptability and flexibility, allowing a user to adjust the fastening degree of the backpack according to needs; as an alternative, the flexible binding piece may be provided on the primary pack 1, and the flexible binding piece abuts against a side, facing away from the primary pack 1, of the secondary pack 2 (as shown in FIG. 6), such a design enhancing the structural stability of the backpack as a whole, in particular when heavy objects or irregularly shaped objects are loaded; alternatively, the flexible binding piece may also be provided on the secondary pack 2, the flexible binding piece abuts against a side, facing away from the secondary pack, of the primary pack 1 (as shown in FIG. 7), thus allowing a more flexible fixing of the secondary pack 2 on the primary pack 1, providing personalized adjustment options and better adaptability.

In summary, the detachable backpack provided in the present disclosure has the features of good flexibility and high security; the primary pack and the secondary pack both have independent inner accommodation spaces, so that a user can choose to use them alone or in combination according to different loading requirements and use scenarios, increasing the practicability and flexibility of the backpack; the design of the quick-release structure allows the user to quickly and conveniently connect or separate the primary pack and the secondary pack without complicated operations or tools, greatly improving the use efficiency and satisfying the pursuit of efficiency in the fast-paced life; the fitting design of the first hidden surface and the second hidden surface not only makes the appearance of the backpack neat and uniform in a connected state, but also enhances the aesthetics and the overall feeling of the backpack by hiding the closure, so as to avoid the visual disorder which may be caused by the exposure of the closure like traditional backpacks; the concealed arrangement of the closure, in addition to improving aesthetics, also has practical functionality. The hidden closure is not easily detected by others, thereby reducing the risk of articles being stolen in public use and improving the security of the backpack; the provision of the accommodation opening allows the user to conveniently access the accommodation space inside the backpack, and the opening and closing mechanism of the closure ensures the safety and stability of the loaded articles, preventing the articles from being accidentally dropped during movement; the design of the inner accommodation spaces of the primary pack and the secondary pack can be adjusted and optimized according to the specific requirements of the user. For example, different partitions, pockets or fixing straps can be designed to accommodate different types of articles at storage; the detachable design of the backpack also allows the user to choose to carry the primary pack or the secondary pack or both together according to the length of travel or the requirements of daily use, providing a high degree of personalization and customization options; this design of the backpack is also of environmental interest as it encourages the user to select the pack body portion to be carried according to actual needs, reducing unnecessary resource consumption and environmental burden.

The above-mentioned description is merely an embodiment of the present disclosure, and does not limit the scope of patent of the present disclosure. Any equivalent transformation made by using the contents of the description and the drawings of the present disclosure or direct or indirect use in the relevant technical field is likewise included in the scope of the patent protection of the present disclosure.

What is claimed is:

1. A detachable backpack, comprising a primary pack, a secondary pack and a quick-release structure, the primary pack and the secondary pack being detachably connected via the quick-release structure, the primary pack and the secondary pack both having an inner accommodation space, the primary pack being provided with a first hidden surface, the secondary pack being provided with a second hidden surface, the first hidden surface being configured for fitting with the second hidden surface, the first hidden surface and/or the second hidden surface being provided with an accommodation opening communicating with the inner accommodation space, a closure being provided at the accommodation opening, and opening and closing of the accommodation opening being realized via the closure, the closure being positioned between the first hidden surface and the second hidden surface when the primary pack and the secondary pack are connected; wherein the quick-release structure comprises a first connector and a second connector detachably connected to the first connector, the first connector being provided on the primary pack and the second connector being provided on the secondary pack;

the first connector is provided on the first hidden surface and the second connector is provided on the second hidden surface; and a first flexible shield is provided within the inner accommodation space of the primary pack, the accommodation opening is provided on the first hidden surface, and the first flexible shield is configured to shield the first connector.

2. The detachable backpack according to claim 1, wherein the first flexible shield is provided with the second connector.

3. The detachable backpack according to claim 1, wherein a second flexible shield is provided within the inner accommodation space of the secondary pack, the accommodation opening is provided on the second hidden surface, and the second flexible shield is configured to shield the second connector.

4. The detachable backpack according to claim 3, wherein the second flexible shield is provided with the first connector.

5. The detachable backpack according to claim 1, wherein the quick-release structure is a flexible binding piece.

6. The detachable backpack according to claim 5, wherein the flexible binding piece is provided on the primary pack, and the flexible binding piece abuts against a side, facing away from the secondary pack, of the secondary pack.

7. The detachable backpack according to claim 6, wherein the flexible binding piece is a binding strap, a bunch cord, an elastic cord, or a net bag.

8. The detachable backpack according to claim 5, wherein the flexible binding piece is provided on the secondary pack, and the flexible binding piece abuts against a side, facing away from the primary pack, of the primary pack.

9. The detachable backpack according to claim 8, wherein the flexible binding piece is a binding strap, a bunch cord, an elastic cord, or a net bag.

* * * * *